United States Patent [19]

Chaffee et al.

[11] Patent Number: 4,727,960

[45] Date of Patent: Mar. 1, 1988

[54] SUPPORT STRUCTURE

[76] Inventors: William H. Chaffee, 6135 S. Oak Park Ave., Chicago, Ill. 60638; Thomas B. Dilworth, Lynnwood Farm, Port Republic, Va. 24471

[21] Appl. No.: 69,718

[22] Filed: Jul. 6, 1987

[51] Int. Cl.[4] ..... B27B 21/00

[52] U.S. Cl. ..... 182/182; 182/224

[58] Field of Search ..... 182/181–186, 182/224–226, 151

[56] References Cited

U.S. PATENT DOCUMENTS

| | | | |
|---|---|---|---|
| 424,879 | 4/1980 | Golder | 182/182 |
| 984,846 | 2/1911 | Pichler | 182/182 |
| 2,257,876 | 10/1941 | Berchem | 182/182 |
| 2,633,221 | 3/1953 | Roeder | 182/184 |
| 3,379,282 | 4/1968 | Knuth | 182/151 |
| 4,071,113 | 1/1978 | Pelser | 182/181 |
| 4,105,091 | 8/1978 | Mahan | 182/224 |
| 4,433,753 | 2/1984 | Watson | 182/224 |
| 4,506,761 | 3/1985 | Brown | 182/186 |

*Primary Examiner*—Reinaldo P. Machado
*Attorney, Agent, or Firm*—Wood, Dalton, Phillips, Mason & Rowe

[57] ABSTRACT

A support structure adapted for facilitated assembly. The support structure includes a base portion in the general configuration of a sawhorse having spaced horizontal sideboards secured to angled legs at opposite ends thereof in recesses provided in the upper end portions of the legs. Bolts are provided for securing the sideboards to the legs and maintaining the upper end portions of the legs in locked abutting relationship. The outer edges of the upper end portions of the legs are received in slots on the inner surfaces of the sideboards for further improved rigidity of the support structure. Different upper extensions are provided, with adjustable clamping structure for permitting variable height of horizontal supports carried on the upper end of upright portions thereof. A ladder is removably associated with the support.

23 Claims, 11 Drawing Figures

SUPPORT STRUCTURE

TECHNICAL FIELD

This invention relates to support structures and in particular to legged support structures.

BACKGROUND ART

In one conventional form of legged support structure, a pair of legs are angled downwardly from opposite ends of a horizontal beam. Such support structures are conventionally used as sawhorses.

Different means are provided for securing the legs to the beam in such support structures. The support structures are conventionally formed of wood and the securing means conventionally comprise bolt means.

DISCLOSURE OF INVENTION

The present invention comprehends an improved support structure wherein a pair of spaced horizontal support beams are utilized in lieu of the single support beam of the conventional support structures.

The legs of the support structure are provided with recesses at their upper ends for receiving end portions of the beams for improved stabilized association of the elements of the support structure.

In the illustrated embodiment, the horizontal elements comprise sideboards.

The sideboards are secured to the upper ends of the leg by bolts extending through aligned bores of the sideboards and upper end portions of the legs.

The legs comprise leg boards having upper end portions defining vertical side edges. The outer side edges of the upper end portions define the recesses for receiving the ends of the sideboards, and the inner side edges are clamped in abutting facial engagement by the securing bolts.

In the illustrated embodiment, a pair of securing bolts is provided at each end of the support structure.

The grain of the leg boards preferably runs generally parallel to the longitudinal extent of the upper ends of the leg boards and, thus, substantially perpendicularly to the clamping force exerted by the securing bolts.

The support structure may include an upper extension wherein a pair of uprights is provided at each end of the support clamped to the outer side faces of the upper end portions of the legs by suitable clamp blocks and securing bolts.

A horizontal upper support beam extends between the extension uprights at the upper ends thereof and is secured thereto by suitable means, such as bolts.

The uprights are longitudinally adjustably secured by the clamping means so as to locate the upper support at a desired elevated location.

In another form, the upper support comprises a board having its flatwise extent perpendicular to the uprights for supporting objects.

A ladder may be removably secured to the support and, in the illustrated embodiment, includes an upper end portion provided with hooks adapted to engage one of the sideboards, whereby the support effectively defines a step stool.

The support may be readily knocked down and erected with the threaded securing means permitting facilitated positive secured association of the elements in the erected arrangement.

The support structure of the present invention is extremely simple and economical of construction, while yet providing the highly desirable features discussed above.

BRIEF DESCRIPTION OF THE DRAWING

Other features and advantages of the invention will be apparent from the following description taken in connection with the accompanying drawing wherein.

BEST MODE FOR CARRYING OUT THE INVENTION

Figures 1, 2, 3, 4, 5, 6, 7, 8, 9, 10, 11:
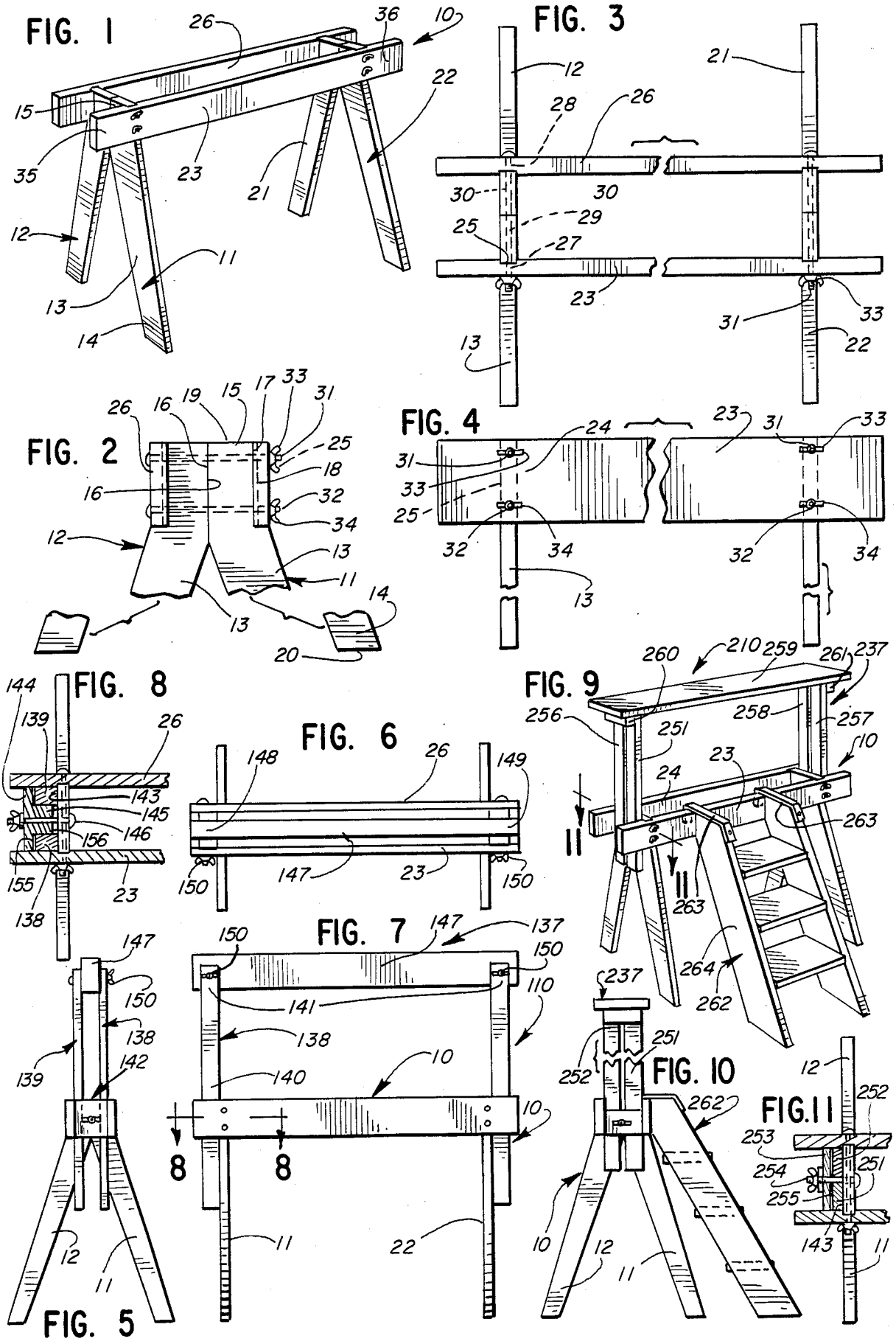
FIG. 1 is a perspective view of a support structure embodying the invention illustratively comprising a sawhorse.
FIG. 2 is a fragmentary end view thereof.
FIG. 3 is a fragmentary top plan view thereof.
FIG. 4 is a fragmentary side elevation thereof.
FIG. 5 is an end view of a modified form of support structure embodying the invention.
FIG. 6 is a top plan view thereof.
FIG. 7 is a side elevation thereof.
FIG. 8 is a fragmentary horizontal section taken substantially along the line 8—8 of FIG. 7.
FIG. 9 is a perspective view of a further modified form of support structure embodying the invention.
FIG. 10 is a fragmentary end elevation thereof.
FIG. 11 is a horizontal section taken substantially along the line 11—11 of FIG. 9.

In the illustrative embodiment of the invention as disclosed in FIGS. 1–4 of the drawing, a support structure generally designated 10 is shown to comprise a pair of first wood leg boards 11 and 12, each having a longitudinally elongated midportion 13, a lower end portion 14, and an upper end portion 15.

The upper end portion defines an inner edge 16 extending at a preselected angle to the longitudinal extent of the midportion 13, and an outer edge 17 defining a rectangular recess having an inner face 18 extending parallel to inner edge 16. Upper end portion 15 further defines an upper end edge 19 extending perpendicularly to inner edge 16 and inner face 18 of recess 17.

Lower edge portion 14 defines a lower end edge 20 extending parallel to upper end edge 19 and adapted to support the legs on a horizontal subjacent ground surface.

The inner edges 16 of the upper ends of the legs 12 and 13 facially abut each other, with the legs extending downwardly from the upper end portions in downwardly widening angular relationship, as illustrated in FIG. 1.

The support includes a pair of second wood leg boards 21 and 22 of construction similar to that of leg boards 12 and 13, as illustrated in FIG. 1.

As discussed briefly above, the support structure of the present invention includes a pair of horizontal beam supports extending between the leg pairs and, more specifically, as illustrated in FIG. 1, includes a first horizontally extending sideboard 23 having a first end portion 24 received in recess 17 of first leg upper end portion 15.

Sideboard portion 24 is provided with a vertical slot 25 receiving the outer edge portion of the leg upper end portion 15, as illustrated in FIG. 2.

A second sideboard 26 is similarly constructed and mounted to the upper end of leg board 12, as shown in FIG. 2.

The sideboards are provided with through bores 27 and 28, respectively, and the leg end portions are provided with aligned through bores 29 and 30, respectively. Extending sequentially through each of the bores is a pair of bolts 31 and 32 provided with wing nuts 33 and 34, respectively, for securing the sideboards to the upper leg portions in the recesses thereof, and securing the inner faces 16 of the upper ends of the legs in positive facial abutment, as best seen in FIG. 2.

As best seen in FIGS. 3 and 4, similar securing means are provided at the opposite ends of the sideboards 23 and 26 for securing the legs 21 and 22 therebetween.

As illustrated in FIG. 2, the leg boards have grain patterns G extending generally parallel to the midportions 13.

The distal ends 35 and 36 of the sideboards are cantilevered outwardly from the portion of the sideboards receiving the edge portions of the legs.

The support structure 10 may be utilized in the conventional manner of a sawhorse. In addition, the spaced relationship of the sideboards 23 and 26 permits cutting by saw means extending downwardly therebetween. Further, because of the spacing of the sideboards 23 and 26, a shelf board may be placed thereon whereby the support structure effectively defines a shelf or table support structure.

The invention further comprehends the provision of a modified form of support structure generally designated 110 utilizing an upper extension structure generally designated 137 adjustably mounted to the support structure 10, as shown in FIGS. 5–8.

More specifically, upper extension structure 137 includes a pair of uprights 138 and 139, each having a clampable portion 140 and an upper end 141. A clamp block generally designated 142 clamps the clampable portions 140 of the respective uprights 138 and 139 to the outboard face 143 of the leg upper end portions 15.

More specifically, as shown in FIG. 8, the clamp block includes a base portion 144 and a boss 145 projecting from the base portion to between the uprights 138 and 139. Threaded securing means 146 extend through the clamp block and upper leg end portions for urging the clamp block forcibly toward the leg upper end portions, thereby firmly clamping the uprights to the upper leg portions surface 143. As shown in FIG. 8, the securing means 146 comprises wing nut and bolt securing means similar to that utilized for clamping the sideboards to the leg portion upper ends.

Thus, the clampable portions may be clamped to the leg upper end portions adjustably lengthwise thereof so as to dispose the upper ends 141 of the uprights at a desired height.

A horizontally extending upper support board 147 has opposite end portions 148 and 149 secured between the upper ends 141 of the uprights by suitable threaded securing means 150.

Thus, the extension board 147 defines a horizontal beam disposed selectively at an adjustable height above the support structure 10 as desired by the user. The upper extension structure 137 may be readily installed and removed from the lower support structure 10 as desired.

A further modified form of support structure generally designated 210 is illustrated in FIGS. 9–11. Support structure 210 is generally similar to support structure 110 but utilizes a pair of uprights 251 and 252 having a width somewhat greater than the uprights 138 and 139 of support structure 137, so as to extend, in combination, substantially fully between the sideboards 23 and 24 of the lower support structure 10.

Uprights 251 and 252 are clamped to the outboard face 143 of the upper leg portions by a clamp block 253 and cooperating threaded securing means 254.

Clamp block 253 differs from clamp block 144 in omitting the projecting portion 145, which, as seen in FIG. 8, extends to between the narrower uprights 138 and 139 to maintain them in facial engagement with the inner surfaces of the sideboards 23 and 26.

A friction pad 155 is provided between base 144 and uprights 138 and 139 for effectively locking the uprights in the adjusted position upon tightening of the clamp. A spring 156 is provided between the projection boss 145 and the surface 143 of the leg upper end portions.

Similarly, a friction pad 255 may be provided between the clamp block 253 and the uprights 251 and 252.

A second pair of uprights 257 and 258 are provided at the opposite end of the sideboards and are secured thereto by similar securing means.

A shelf 259 is mounted to the upper ends of the uprights 251, 252, 257 and 258 and depending blocks 260 and 261 provided on the underside of the shelf to engage the upper ends of the uprights outboard thereof and lock the shelf against longitudinal displacement on the uprights.

Thus, the shelf 259 may be adjustably positioned by suitable longitudinal adjustment of the uprights at any desired height.

To provide facilitated access to the elevated shelf 259, a short stepladder 262 is provided, having angle hooks 263 on the side rails 264 thereof adapted to hook over either of the sideboards 23 or 24 of the support structure 10. Thus, the support structure may be utilized as a step stool with or without the upper extension structure 237.

In the illustrated embodiment, the clamp blocks define side edges facially engaging the sideboards so as to be fitted therebetween. The clamp blocks have a height substantially equal to the height of the leg board upper end portions.

The width of the shelf 259 may be similar to the spacing between the outer surfaces of the sideboards 23 and 24, as illustrated in FIG. 10, and the shelf may have a length at least equal to the length of the sideboards, as shown therein.

The improved support structure of the present invention is adapted for a wide range of different uses, including use as a sawhorse, a plant stand, an adjustable support for supporting workpieces to be worked on by machine tools, such as drill presses, band saws, bench saws, etc., a step stool with or without a work surface for supporting paint buckets, etc.

The use of the recesses in the upper end portions of the legs provides for improved stability in the mounting of the sideboards thereto. The mounting of the uprights to the upper end portions of the legs permits ready provision of an adjustable support in overlying relationship to the base structure.

The foregoing disclosure of specific embodiments is illustrative of the broad inventive concepts comprehended by the invention.

I claim:

1. A support structure comprising:

a pair of first wood leg boards defining a pair of first legs, each first leg board having a longitudinally elongated midportion, a lower end portion, and an upper end portion, said upper end portion defining an inner edge extending at a preselected angle to the longitudinal extent of said midportion, an outer edge defining a rectangular recess having an inner face extending parallel to said inner edge, and an upper end edge extending perpendicularly to said inner edge and inner face of said outer edge, said lower edge portion defining a lower end edge extending parallel to said upper end edge, the inner edges of said pair of said first leg boards facially abutting with said first legs extending downwardly from said upper end portion in downwardly widening angular relationship;

a pair of second wood leg boards defining a pair of second legs, each second leg board having a longitudinally elongated midportion, a lower end portion, and an upper end portion, said upper end portion defining an inner edge extending at a preselected angle to the longitudinal extent of said midportion, an outer edge defining a rectangular recess having an inner face substantially parallel to said inner edge, and an upper end edge extending perpendicularly to said inner edge and inner face of said outer edge, said lower edge portion defining a lower end edge extending parallel to said upper end edge, the inner edges of said pair of second leg boards facially abutting with said second legs extending downwardly from said upper end portions thereof in downwardly widening angular relationship;

a first horizontally extending sideboard having a first end portion received in said recess of said upper end portion of one of said first leg boards and a second end portion received in said recess of said upper end portion of one of said second leg boards, said first sideboard end portions each having a vertical slot snugly receiving a portion of the leg boards defining the inner end of the recesses;

a second horizontally extending sideboard having a first end portion received in said recess of said upper end portion of the other of said first leg boards, and a second end portion received in said recess of said upper end portion of the other of said second leg boards, said second sideboard end portions each having a vertical slot snugly receiving the portion of the second leg board defining the inner end of the recesses thereof, said upper end portions of the first leg boards and said first end portions of said first sideboards having aligned first through bores extending parallel to the flatwise extent of said first leg boards and perpendicularly to the flatwise extent of said first sideboards, said upper end portions of the second leg boards and said second end portions of said second sideboards having aligned second through bores extending parallel to the flatwise extent of said second leg boards and perpendicularly to the flatwise extent of said second sideboards;

first threaded securing means extending through said first through bores for securely clamping said upper ends of said first leg boards between said first end portions of said first sideboards; and second threaded securing means extending through said second through bores for securely clamping said upper ends of said second leg boards between said second end portions of said second sideboards.

2. The support structure of claim 1 wherein said end of said leg boards defines a grain pattern extending parallel to said midportion thereof.

3. The support structure of claim 1 wherein a pair of said aligned through bores and threaded securing means is provided at each end of the support structure.

4. The support structure of claim 1 wherein each sideboard end portion includes a distal portion cantilevered outwardly from the portion received in said leg board recess.

5. The support structure of claim 1 wherein the through bores in each of said upper ends of said leg boards open through the center of the recess thereof.

6. The support structure of claim 1 wherein said sideboards define top and bottom edges and a pair of said aligned through bores and threaded securing means is provided at each end of the support structure and one each adjacent said top and bottom edges.

7. A support structure comprising:

a pair of first wood leg boards defining a pair of first legs, each first leg board having a longitudinally elongated midportion, a lower end portion, and an upper end portion, said upper end portion defining an inner edge extending at a preselected angle to the longitudinal extent of said midportion, an outer edge defining a rectangular recess having an inner face extending parallel to said inner edge, and an upper end edge extending perpendicularly to said inner edge and inner face of said outer edge, said lower edge portion defining a lower end edge extending parallel to said upper end edge, the inner edges of said pair of said first leg boards facially abutting with said first legs extending downwardly from said upper end portion in downwardly widening angular relationship;

a pair of second wood leg boards defining a pair of second legs, each second leg board having a longitudinally elongated midportion, a lower end portion, and an upper end portion, said upper end portion defining an inner edge extending at a preselected angle to the longitudinal extent of said midportion, an outer edge defining a rectangular recess having an inner face substantially parallel to said inner edge, and an upper end edge extending perpendicularly to said inner edge and inner face of said outer edge, said lower edge portion defining a lower end edge extending parallel to said upper end edge, the inner edges of said pair of second leg boards facially abutting with said second legs extending downwardly from said upper end portions thereof in downwardly widening angular relationship;

a first horizontally extending sideboard having a first end portion received in said recess of said upper end portion of one of said first leg boards and a second end portion received in said recess of said upper end portion of one of said second leg boards, said first sideboard end portions each having a vertical slot snugly receiving a portion of the leg boards defining the inner end of the recesses;

a second horizontally extending sideboard having a first end portion received in said recess of said upper end portion of the other of said first leg boards, and a second end portion received in said recess of said upper end portion of the other of said second leg boards, said second sideboard end portions each having a vertical slot snugly receiving the portion of the second leg board defining the inner end of the recesses thereof, said upper end portions of the first leg boards and said first end portions of said first sideboards having aligned first through bores extending parallel to the flatwise extent of said first leg boards and perpendicularly to the flatwise extent of said first sideboards, said upper end portions of the second leg boards and said second end portions of said second sideboards having aligned second through bores extending parallel to the flatwise extent of said second leg boards and perpendicularly to the flatwise extent of said second sideboards;

first threaded securing means extending through said first through bores for securely clamping said upper ends of said first leg boards between said first end portions of said first sideboards;

second threaded securing means extending through said second through bores for securely clamping said upper ends of said second leg boards between said second end portions of said second sideboards;

an upper extension structure including a pair of first uprights each having a clampable portion and an upper end, a first clamp block having a base and a boss projecting from said base to between said clampable portions of said first uprights, and first threaded securing means extending through said first clamp and said upper end portions of said first leg boards for causing said clamp block base to clamp said lower portions of said first uprights longitudinally adjustably to said upper end portions of said first leg boards;

a pair of second uprights each having a clampable portion and an upper end, a second clamp block having a base and a boss projecting from said base to between said clampable portions of said second uprights, and second threaded securing means extending through said second clamp and said upper end portions of said second leg boards for causing said clamp block base to clamp said lower portions of said second uprights longitudinally adjustably to said upper end portions of said second leg boards; and an upper longitudinally extending support having a first end secured to said upper ends of said first uprights, and a second end secured to said upper ends of said second uprights.

8. The support structure of claim 7 wherein threaded securing means are provided for removably securing said ends of the upper support to said uprights.

9. The support structure of claim 7 further including friction means between said base and said uprights for preventing vertical displacement of the clamped uprights.

10. The support structure of claim 7 further including rubber friction means between said base and said uprights for preventing vertical displacement of the clamped uprights.

11. The support structure of claim 7 wherein spring means are disposed between said boss and said upper end portions of said leg boards.

12. The support structure of claim 7 further including friction means between said base and said uprights for preventing vertical displacement of the clamped uprights and spring means are disposed between said boss and said upper end portions of said leg boards.

13. The support structure of claim 7 wherein said uprights facially engage said sideboards and said clamp block boss is fitted between said uprights to retain said uprights in said facial engagement.

14. The support structure of claim 7 wherein said clamp block base defines side edges facially engaging said sideboards.

15. The support structure of claim 7 wherein said clamp block base has a height substantially equal to the height of said leg board upper end portions.

16. The support structure of claim 7 wherein said upper horizontal support ends are disposed between said upper ends of the respective pairs of uprights.

17. A support structure comprising:

a pair of first wood leg boards defining a pair of first legs, each first leg board having a longitudinally elongated midportion, a lower end portion, and an upper end portion, said upper end portion defining an inner edge extending at a preselected angle to the longitudinal extent of said midportion, an outer edge defining a rectangular recess having an inner face extending parallel to said inner edge, and an upper end edge extending perpendicularly to said inner edge and inner face of said outer edge, said lower edge portion defining a lower end edge extending parallel to said upper end edge, the inner edges of said pair of said first leg boards facially abutting with said first legs extending downwardly from said upper end portion in downwardly widening angular relationship;

a pair of second wood leg boards defining a pair of second legs, each second leg board having a longitudinally elongated midportion, a lower end portion, and an upper end portion, said upper end portion defining an inner edge extending at a preselected angle to the longitudinal extent of said midportion, an outer edge defining a rectangular recess having an inner face substantially parallel to said inner edge, and an upper end edge extending perpendicularly to said inner edge and inner face of said outer edge, said lower edge portion defining a lower end edge extending parallel to said upper end edge, the inner edges of said pair of second leg boards facially abutting with said second legs extending downwardly from said upper end portions thereof in downwardly widening angular relationship;

a first horizontally extending sideboard having a first end portion received in said recess of said upper end portion of one of said first leg boards and a second end portion received in said recess of said upper end portion of one of said second leg boards, said first sideboard end portions each having a vertical slot snugly receiving a portion of the leg boards defining the inner end of the recesses;

a second horizontally extending sideboard having a first end portion received in said recess of said upper end portion of the other of said first leg boards, and a second end portion received in said recess of said upper end portion of the other of said second leg boards, said second sideboard end portions each having a vertical slot snugly receiving the portion of the second leg board defining the inner end of the recesses thereof, said upper end portions of the first leg boards and said first end portions of said first sideboards having aligned first through bores extending parallel to the flatwise extent of said first leg boards and perpendicularly to the flatwise extent of said first sideboards, said upper end portions of the second leg boards and said second end portion of said second sideboards having aligned second through bores extending parallel to the flatwise extent of said second leg boards and perpendicularly to the flatwise extent of said second sideboards;

first threaded securing means extending through said first through bores for securely clamping said upper ends of said first leg boards between said first end portions of said first sideboards;

second threaded securing means extending through said second through bores for securely clamping said upper ends of said second leg boards between said second end portions of said second sideboards;

an upper extension structure including a pair of first uprights each having a clampable portion and an upper end, a first clamp block, and first threaded securing means extending through said first clamp and said upper end portions of said first leg boards for causing said clamp block to clamp said lower portions of said first uprights longitudinally adjustably to said upper end portions of said first leg boards;

a pair of second uprights each having a clampable portion and an upper end, a second clamp block, and second threaded securing means extending through said second clamp and said upper end portions of said second leg boards for causing said clamp block to clamp said lower portions of said second uprights longitudinally adjustably to said upper end portions of said second leg boards; and an upper longitudinally extending support having a first end secured to said upper ends of said first uprights, and a second end secured to said upper ends of said second uprights, said upper horizontal support having a width at least equal to the spacing between the outer vertical surfaces of said sideboards.

18. The support structure of claim 17 wherein said upper support has a length at least equal to the length of said sideboards.

19. The support structure of claim 17 including a pair of transverse blocks secured one each to said opposite ends of said upper support.

20. The support structure of claim 17 including a pair of transverse blocks secured one each to said opposite ends of said upper support outboard of said pair of uprights.

21. The support structure of claim 17 wherein friction means are provided between said clamp block and said upper ends of the leg boards for preventing vertical displacement of the clamped uprights.

22. The support structure of claim 17 further including a ladder having means for removably connecting an upper end of the ladder selectively to either of said sideboards.

23. The support structure of claim 17 further including a ladder having hook means for removably connecting an upper end of the ladder selectively to either of said sideboards.

* * * * *